US006964249B2

(12) United States Patent
Komaki

(10) Patent No.: US 6,964,249 B2
(45) Date of Patent: Nov. 15, 2005

(54) VALVE TIMING CONTROL SYSTEM FOR INTERNAL COMBUSTION ENGINE

(75) Inventor: Yusaku Komaki, Tochigi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/898,976

(22) Filed: Jul. 27, 2004

(65) Prior Publication Data

US 2005/0028772 A1 Feb. 10, 2005

(30) Foreign Application Priority Data

Aug. 8, 2003 (JP) ..... 2003-289672

(51) Int. Cl.[7] ..... F01L 1/34

(52) U.S. Cl. ..... 123/90.15; 123/90.17; 123/90.31; 464/160

(58) Field of Search ..... 123/90.15, 90.16, 123/90.17, 90.18, 90.27, 90.31; 464/1, 2, 160

(56) References Cited

U.S. PATENT DOCUMENTS 5,588,404 A * 12/1996 Lichti et al. ..... 123/90.17
6,443,113 B1 * 9/2002 Kanada et al. ..... 123/90.17

FOREIGN PATENT DOCUMENTS

JP 11-159311 A 6/1999

* cited by examiner

*Primary Examiner*—Thomas Denion
*Assistant Examiner*—Ching Chang
(74) *Attorney, Agent, or Firm*—Foley & Lardner LLP

(57) ABSTRACT

A valve timing control system includes a hydraulic-pressure supply/discharge device for selectively supplying and discharging working fluid from advance and retard chambers, an annular recess formed in a sidewall member of a housing to face a housing main body and communicating with one supply/discharge passage of the hydraulic-pressure supply/discharge device, and a radial groove radially extending from the annular recess and communicating with the advance chamber or the retard chamber.

20 Claims, 3 Drawing Sheets

VALVE TIMING CONTROL SYSTEM FOR INTERNAL COMBUSTION ENGINE

BACKGROUND OF THE INVENTION

The invention of the present application relates to a valve timing control system for an internal combustion engine, which controls the opening/closing timing of an intake valve and/or an exhaust valve in accordance with the engine operating conditions.

A typical valve timing control system is disclosed in Japanese document JP-A 11-159311. This valve timing control system comprises a housing linked to a crankshaft through a chain, etc. and a vane rotor integrally coupled to a camshaft. The housing and the vane rotor are assembled to be rotatable relative to each other, and the assembling angle therebetween, i.e. the relative rotated position, is changed in accordance with the engine operating conditions. The housing comprises a plurality of partition walls to protrude radially inward, whereas the vane rotor comprises a cylindrical main body arranged in the center of the housing and with which the front ends of the partition walls make slide contact, and vanes arranged to protrude radially from the vane-rotor main body to define advance and retard chambers between adjacent partition walls. The advance and retard chambers are connected to hydraulic-pressure supply/discharge means for selectively switching between supply and discharge of working fluid in accordance with the engine operating conditions.

The housing comprises a main body having a peripheral wall and a partition wall and a sidewall member for closing a side portion of the housing main body on the camshaft side. The sidewall member is formed with a bearing hole for supporting a shank of the camshaft on the front-end side. Supply/discharge of working fluid to one of the advance and retard chambers is carried out via a supply/discharge passage extending from the camshaft through the bearing hole to the sidewall member.

Specifically, the camshaft has a communication passage formed therethrough to extend radially outward from a shaft passage formed along the center of the camshaft, and an annular groove formed in the outer peripheral surface and to which the communication passage opens. The sidewall member is formed with a connection passage for connecting the annular groove of the camshaft to one of the advance and retard chambers. The communication passage of the camshaft and the connection passage of the sidewall member are always in fluid communication via the annular groove.

SUMMARY OF THE INVENTION

With the valve timing control system disclosed in Japanese document JP-A 11-159311, however, since the annular groove is formed in the outer peripheral surface of the camshaft to ensure constant fluid communication between the passage on the camshaft side and the passage on the sidewall-member side, complicated grooving should be applied to the outer peripheral surface of the camshaft, leading to an increase in manufacturing cost of the system.

It is, therefore, an object of the invention of the present application is to provide a valve timing control system for an internal combustion engine, which allows easy formation of the passage for connecting the shank which rotates together with the camshaft through the sidewall member to one of the advance and retard chambers, and thus a reduction in manufacturing cost of the system.

The invention of the present application provides generally a valve timing control system for an internal combustion engine, which comprises: a housing comprising a main body having a peripheral wall and a sidewall member having a bearing hole supporting a shank of a member on the side of a camshaft and closing a side of the main body; an advance chamber arranged in the housing, the advance chamber being supplied with a working fluid to cause a relative rotation of the camshaft in the advance direction with respect to a crankshaft; a retard chamber arranged in the housing, the retard chamber being supplied with the working fluid to cause the relative rotation of the camshaft in the retard direction with respect to the crankshaft; a hydraulic-pressure supply/discharge device which selectively supplies and discharges the working fluid to and from the advance chamber and the retard chamber, the hydraulic-pressure supply/discharge device comprising two supply/discharge passages; an annular recess formed in the sidewall member of the housing to face the housing main body, the annular recess communicating with one of the supply/discharge passages of the hydraulic-pressure supply/discharge device; and a radial groove formed to radially extend from the annular recess, the radial groove communicating with one of the advance chamber and the retard chamber.

BRIEF DESCRIPTION OF THE DRAWINGS

The other objects and features of the invention of the present application will become apparent from the following description with reference to the accompanying drawings, wherein.

DETAILED DESCRIPTION OF THE INVENTION

Figure 1:
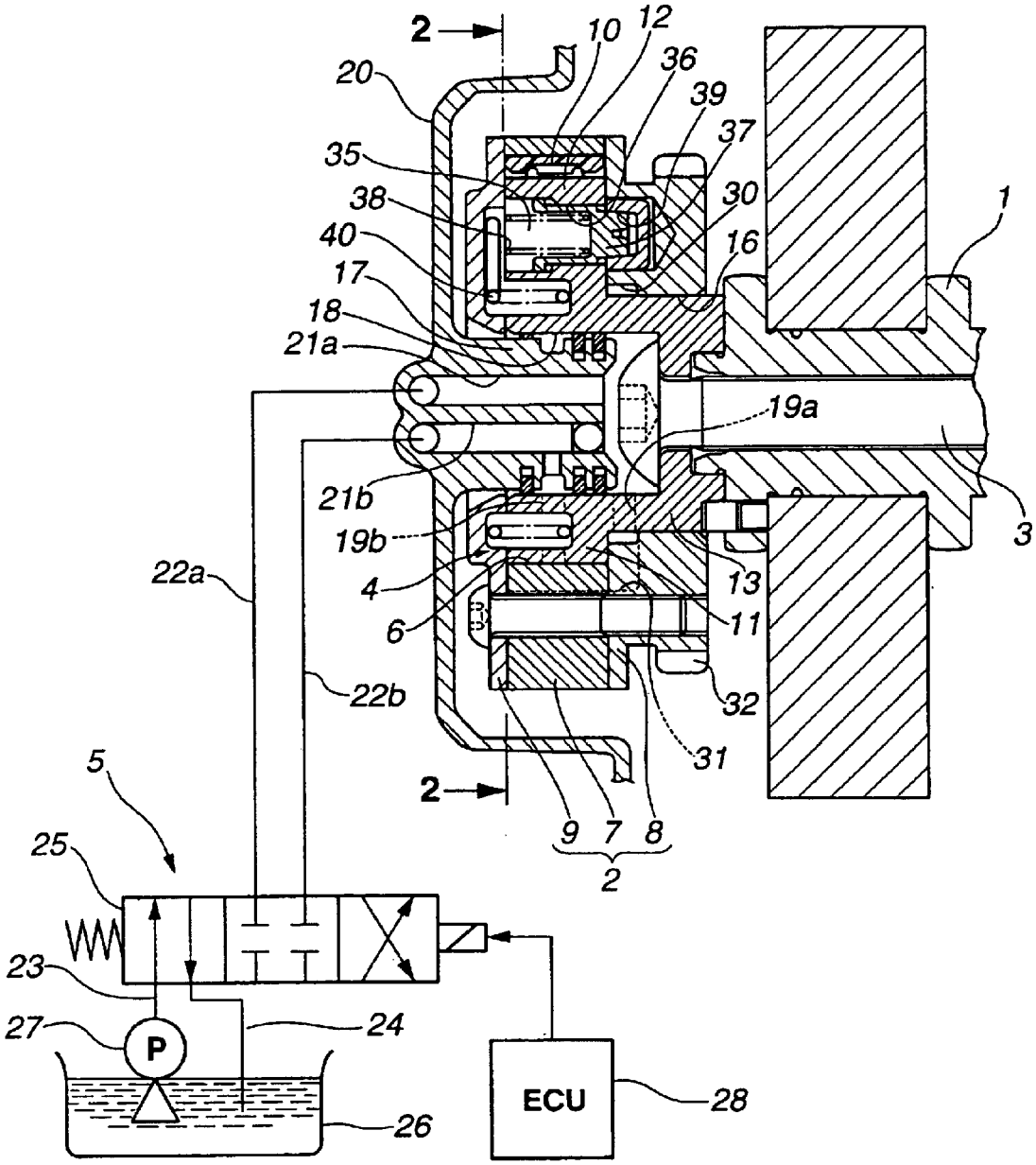
FIG. 1 is a longitudinal sectional view taken along the line 1—1 in FIG. 2, showing a first embodiment of a valve timing control system for an internal combustion engine according to the invention of the present application.

Referring to the drawings wherein like references designate like parts throughout the views, a description will be made about a valve timing control system for an internal combustion engine embodying the invention of the present application.

Referring to FIGS. 1–4, there is shown first embodiment of the invention of the present application. Referring to FIG. 1, the engine comprises an exhaust camshaft 1 rotatably supported on a cylinder head. A crank cam, not shown, is provided to camshaft 1 in the axial center portion to open and close the exhaust valve. A valve timing control system is provided to camshaft 1 at the front end or at the left in FIG. 1. In the first embodiment, the valve timing control system according to the invention is applied to an exhaust-valve drive system. Optionally, the valve timing control system can be applied to an intake-valve drive system.

The valve timing control system comprises a housing 2 driven by a crankshaft of the engine through a chain, not shown, a vane rotor 4 integrally coupled to camshaft 1 at the front end by a cam bolt 3 and having housing 2 assembled to be rotatable relative thereto as required, and a hydraulic-pressure supply/discharge means or device 5 for supplying and discharging working fluid to produce relative rotation between housing 2 and vane rotor 4 in accordance with the engine operating conditions.

Figure 2:
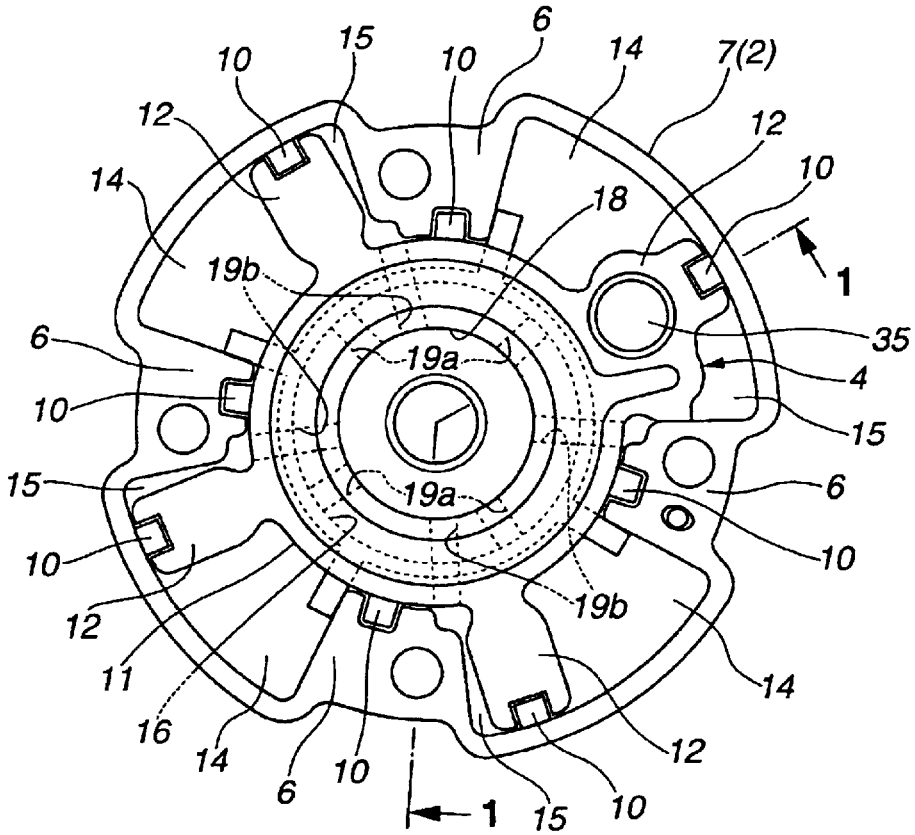
FIG. 2 is a cross sectional view, taken along the line 2—2 in FIG. 1.

Referring also to FIG. 2, housing 2 comprises a roughly cylindrical main body 7 having four partition walls 6 of trapezoidal section roughly equidistantly arranged on the inner periphery of the peripheral wall to protrude radially inward, a rear plate or sidewall member 8 for closing a side portion of housing main body 7 on the side of camshaft 1, and a cover member 9 for closing an opposite side portion of housing main body 7.

Vane rotor 4 comprises a main body 11 arranged in the center of housing 2 and having an outer peripheral surface with which the front ends of partition walls 6 make slide contact through seal members 10, four vanes 12 protruding radially outward from vane-rotor main body 11, and a shank 13 extending from one side of vane-rotor main body 11 toward camshaft 1. Each vane 12 is disposed between partition walls 6 adjacent in the circumferential direction of housing 2 to define therebetween advance and retard chambers 14, 15. Shank 13 is arranged through and supported by a bearing hole 16 formed in rear cover 8, and protrudes from bearing hole 16 to have an end butting on the front end of camshaft 1. Shank 13 is smaller in outer diameter than vane-rotor main body 11. Seal member 10 is mounted to the front end of vane 12 to make slide contact with the inner surface of the peripheral wall of housing main body 7.

A connection hole 18 is formed in the center of the front of vane rotor 4 to engage with a supply/discharge rod 17 as will be described later. First and second radial holes 19*a*, 19*b* are formed through the inner peripheral surface of connection hole 18 to communicate with advance and retard chambers 14, 15, respectively. Connection hole 18 is arranged through vane-rotor main body 11 to reach roughly a middle position of shank 13.

Supply/discharge rod 17 is formed with the inside of a VTC cover 20 mounted to the front end of the cylinder head to protrude axially, and has a pair of inner passages 21*a*, 21*b* formed therethrough to communicate with first and second radial holes 19*a*, 19*b* of vane rotor 4. Supply/discharge of working fluid from advance and retard chambers 14, 15 is carried out through supply/discharge rod 17.

Figure 5:
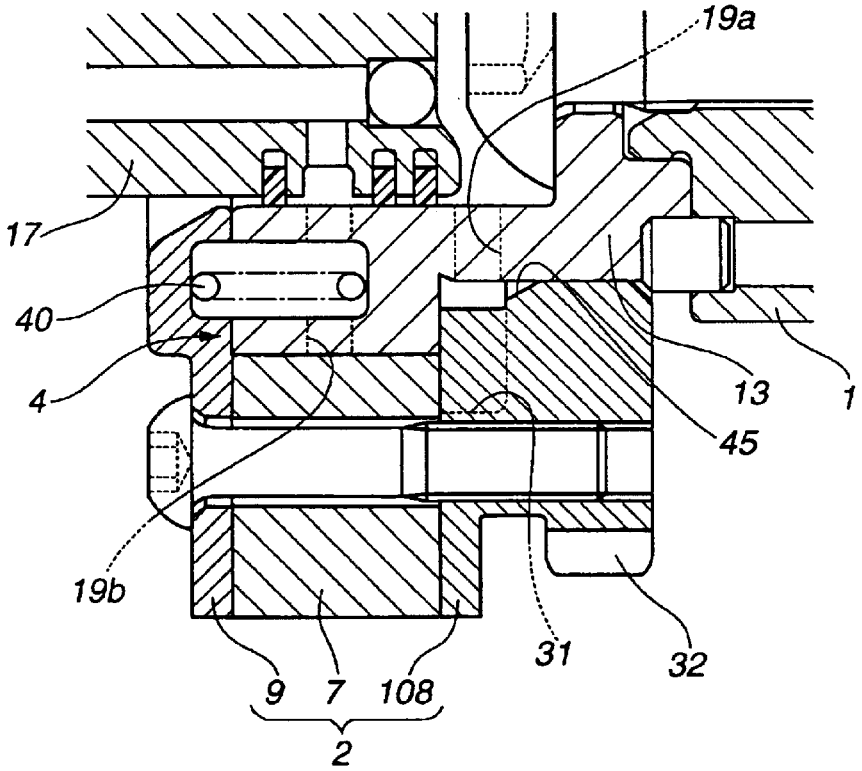
FIG. 5 is an enlarged fragmentary sectional view showing a second embodiment of the invention of the present application.

Referring to FIG. 5, hydraulic-pressure supply/discharge means 5 comprises two hydraulic passages, i.e. a first hydraulic passage 22*a* for supplying and discharging working fluid from advance chamber 14 via inner passage 21*a* of supply/discharge rod 17 and first radial hole 19*a* of vane rotor 4, and a second hydraulic passage 22*b* for supplying and discharging working fluid from retard chamber 15 via inner passage 21*b* of supply/discharge rod 17 and second radial hole 19*b* of vane rotor 4. A supply passage 23 and a drain passage 24 are connected to first and second hydraulic passages 21*a*, 21*b* through an electromagnetic switching valve 25 for carrying out passage switching. An oil pan 26 is arranged on the bottom of the engine, and an oil pump 27 is arranged to supply working fluid in oil pan 26. An electronic control unit (ECU) 28 serves to control electromagnetic switching valves 25.

First radial hole 19*a* is radially formed through shank 13 to provide fluid communication between rear plate 8 and advance chamber 14 via shank 13 and bearing hole 16. Second radial hole 19*b* is radially formed through vane-rotor main body 11 to directly communicate with retard chamber 15. A concrete structure of passage for connecting first radial hole 19*a* to advance chamber 14 will be described in detail below.

Figure 3:
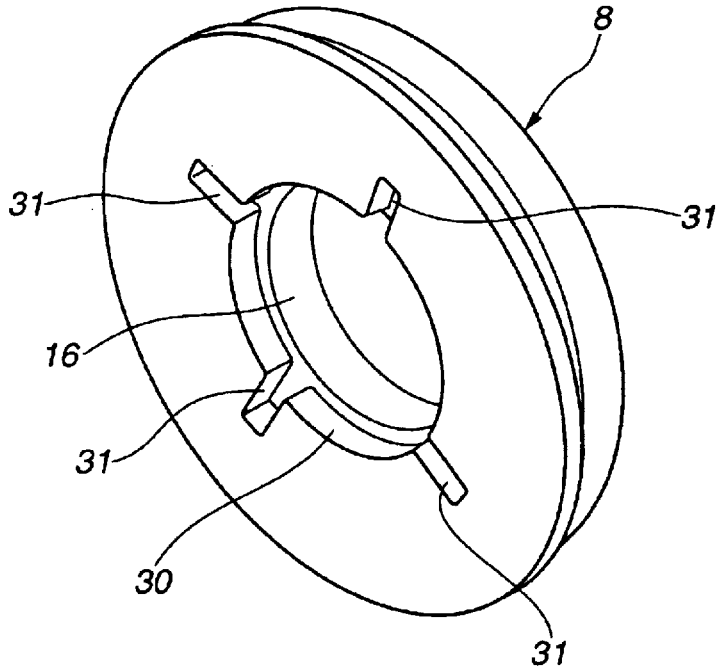
FIG. 3 is a perspective view of a rear plate.
Figure 4:
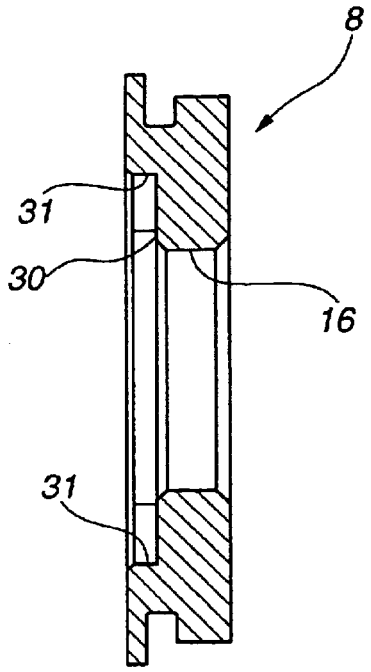
FIG. 4 is a view similar to FIG. 1, showing the rear plate.

First radial hole 19*a* opens a connection of shank 13 of vane rotor 13 with vane-rotor main body 11. Referring to FIGS. 3 and 4, rear plate 8 has an annular recess 30 formed stepwise in an edge of bearing hole 16 facing the side face of vane-rotor main body 11. Annular recess 30 has smaller diameter than outer diameter of vane-rotor main body 11 to define an annular passage between the outer peripheral surface of shank 13 of vane rotor 4 and the side face of vane-rotor main body 11. Moreover, rear plate 8 has four radial grooves 31 formed in the side face on the side of housing main body 7 to provide fluid communication between annular recess 30 and respective advance chambers 14 across the sidewall of vane-rotor main body 11. Each radial groove 31 opens to the side face of partition wall 6 of housing main body 7 facing advance chamber 14.

In the first embodiment, a chain sprocket 32 serving as a power transfer part is integrated with the outer periphery of the rear end rear plate 8, through which power of the crankshaft is transferred to housing 2.

Referring to FIG. 1, a lock mechanism 35 is arranged to restrict relative rotation between housing 2 and vane rotor 4 at engine start, etc. Lock mechanism 35 comprises a pin hole 36 axially formed through one vane 12 of vane rotor 4, a lock pin 37 slidably accommodated in pin hole 36, a spring or biasing means 38 accommodated in pin hole 36 together with lock pin 37 for biasing lock pin 37 in the direction of rear plate 8, a lock hole 39 formed in the inner surface of rear plate 8 and engaging with the front end of lock pin 37 when vane rotor 4 is in the maximum advance position, and a release passage, not shown, serving to operate the lock releasing hydraulic pressure to lock pin 37. A torsion spring 40 of the coil-spring type is connected to housing 2 and vane rotor 4 to put the two back to the maximum advance position at engine stop, etc.

Operation of the first embodiment will be described below.

At engine start, with vane rotor 4 rotated to the maximum advance position with respect to housing 2, lock mechanism 35 locks the two mechanically, so that torque of the crankshaft is transferred to camshaft 1 as it is. Thus, camshaft 1 opens and closes the exhaust valve at the advance timing.

Then, when, after engine start, operation of electromagnetic switching valve 25 provides fluid communication between supply passage 23 and advance chamber 14 and between drain passage 24 and retard chamber 15, high-pressure working fluid is introduced into retard chamber 15, and locking of lock mechanism 35 is released by the resultant hydraulic pressure. With this, vane rotor 4 is rotated in the retard direction with respect to housing 2 under the hydraulic pressure within retard chamber 15. Thus, camshaft 1 opens and closes the exhaust valve at the retard timing.

Then, when operation of electromagnetic switching valve 25 provides fluid communication between supply passage 23 and advance chamber 14 and between drain passage 24 and retard chamber 15, vane rotor 4 is rotated in the advance direction with respect to housing 2 under the hydraulic pressure within advance chamber 14. Thus, camshaft 1 opens and closes the exhaust valve at the advance timing.

In the first embodiment, first radial hole 19*a* of shank 13 of vane rotor 4 always communicates with advance chamber 14 via annular recess 30 formed stepwise in an edge of bearing hole 16 of rear plate 8 and radial grooves 31 formed in the side face of rear plate 8 on the side of housing main body 7. As being shaped to open to one side face of rear plate 8, annular recess 30 and radial grooves 31 can be obtained easily and accurately by die forming, etc. Specifically, when obtaining rear plate 8 by die forming, for example, the opening direction of annular recess 30 and radial grooves 31 is set as the mold direction, allowing achievement of annular recess 30 and radial grooves 31 nearly by die forming only. Therefore, the first embodiment contributes to great enhancement in production efficiency as compared with the related art wherein the annular groove is formed in the outer peripheral surface of the camshaft by machining, etc.

Moreover, in the first embodiment, radial grooves 31 for connecting annular recess 30 to respective advance chambers 14 open to the side face of partition wall 6 facing advance chamber 14. Thus, even when vane 12 of vane rotor 4 is any rotated position, radial grooves 31 can always surely communicate with respective advance chambers 14, leading to sure achievement of valve timing control.

In the first embodiment, sprocket 32 serving as a power transfer part is integrated with the outer periphery of rear plate 8. Optionally, the power transfer part such as sprocket 32 may be a member separate and distinct from rear plate 8. It is noted that, when the power transfer part is integrated with rear plate 8 as in the first embodiment, a further reduction in manufacturing cost of the system can be obtained due to reduced number of component parts.

Figure 6:
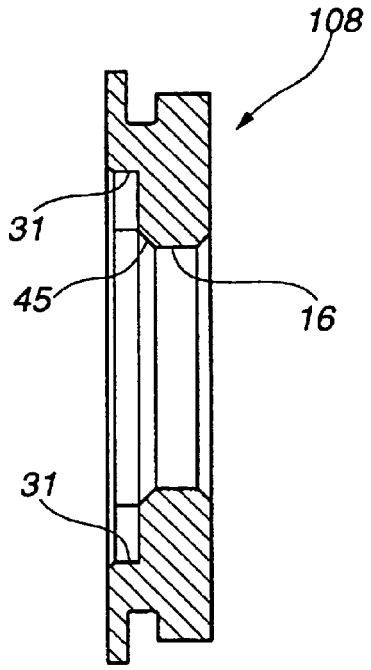
FIG. 6 is a view similar to FIG. 4, showing the rear plate in the second embodiment. 11

Referring to FIGS. 5 and 6, there is shown second embodiment of the invention of the present application, which is substantially the same in fundamental structure as the first embodiment except the shape of an end of bearing hole 16 of a rear plate 108.

In the second embodiment, in the same way as the first embodiment, rear plate 108 has annular recess 30 formed in an edge of bearing hole 16 facing the side face of vane-rotor main body 11 and having smaller diameter than outer diameter of vane-rotor main body 11, and radial grooves 31 formed in the side face on the side of housing main body 7 to provide fluid communication between annular recess 30 and respective advance chambers 14. As distinct from the first embodiment, taper 45 is formed on the bottom of annular groove 30 in the axial direction to incline toward a general surface of bearing hole 16 in a taper way.

In the second embodiment, while taper 45 is formed on the bottom of annular recess 30 of rear plate 108, annular recess 30 and radial grooves 31 are formed to open to one side face of rear plate 108, allowing their easy achievement by die forming, etc. in the same way as the first embodiment. Moreover, rear plate 108 has taper 45 formed on the bottom, so that, when shank 13 is arranged through and supported by bearing hole 16 of rear plate 108, shank 13 can easily be inserted into bearing hole 16 using taper 45 as a guide.

As described above, according to the invention of the present application, the annular recess formed in the sidewall member serves as an annular passage between the shank and the side face of the vane-rotor main body, the annular passage communicating with one of the advance and retard chambers through the radial grooves of the sidewall member. Thus, a passage connected to one of the advance and retard chambers can easily be obtained without forming an annular groove in the shank rotated together with the camshaft. Specifically, when forming the annular recess and radial grooves in the sidewall member, both of the two open to the side face of the sidewall member on the side of the housing main body, allowing their easy achievement by die forming, etc. This results in a reduction in manufacturing cost of the system.

Further, the taper formed on the bottom of the annular recess in the axial direction serves as a guide when inserting the shank into the bearing hole, resulting in enhanced assembling efficiency of the system.

Still further, the radial grooves always open to one of the advance and retard chambers regardless of the relative rotated position of the housing and the vane rotor, resulting in achievement of sure operation of the system.

Furthermore, there is no need to mount a separate and distinct power transfer member to the housing, resulting in a further reduction in manufacturing cost of the system.

Having described the invention of the present application in connection with the illustrative embodiments, it is noted that the invention of the present application is not limited thereto, and various changes and modifications can be made without departing from the scope of the invention of the present application. By way of example, in the illustrative embodiments, supply/discharge rod 17 is formed with VTC cover 20, and shank 13 is provided to vane rotor 4 through which supply/discharge rod 17 is arranged. Optionally, it is possible to form a supply/discharge passage through camshaft 1 and to use the front end of camshaft 1 as a shank arranged through bearing hole 16.

The entire teaching of Japanese Patent Application P2003-289672 filed Aug. 8, 2003 are hereby incorporated by reference.

What is claimed:

1. A valve timing control system for an internal combustion engine, comprising:

a housing comprising a main body having a peripheral wall and a sidewall member having a bearing hole supporting a shank of a member on the side of a camshaft and closing a side of the main body;

an advance chamber arranged in the housing, the advance chamber being supplied with a working fluid to cause a relative rotation of the camshaft in the advance direction with respect to a crankshaft;

a retard chamber arranged in the housing, the retard chamber being supplied with the working fluid to cause the relative rotation of the camshaft in the retard direction with respect to the crankshaft;

a hydraulic-pressure supply/discharge device which selectively supplies and discharges the working fluid to and from the advance chamber and the retard chamber, the hydraulic-pressure supply/discharge device comprising two supply/discharge passages;

an annular recess formed in the sidewall member of the housing to face the housing main body, the annular recess communicating with one of the supply/discharge passages of the hydraulic-pressure supply/discharge device; and a radial groove formed to radially extend from the annular recess, the radial groove communicating with one of the advance chamber and the retard chamber.

2. A valve timing control system for an internal combustion engine, comprising:

a housing comprising a peripheral wall and partition walls protruding radially inward from the peripheral wall, the housing being rotated by torque transmitted from a crankshaft;

a vane rotor arranged in the housing, the vane rotor comprising a substantially cylindrical main body with which front ends of the partition walls make slide contact and vanes protruding radially outward from the main body, the vane rotor being integrated with a camshaft to be rotatable together, the vane rotor being mounted to the housing to be rotatable relative thereto as required;

advance and retard chambers formed between the partition walls of the housing and the vanes of the vane rotor;

a hydraulic-pressure supply/discharge device which selectively supplies and discharges a working fluid to and from the advance and retard chambers to cause a relative rotation between the housing and the vane rotor, the hydraulic-pressure supply/discharge device comprising two supply/discharge passages, the housing comprising a main body having the peripheral wall and a sidewall member mounted to the main body to close a side of the main body on the side of the camshaft, the sidewall member being formed with a bearing hole having a diameter smaller than that of the vane-rotor main body and supporting a shank provided to one of the vane rotor and the camshaft, one of the supply/discharge passages of the hydraulic-pressure supply/discharge device connecting the sidewall member to one of the advance and retard chambers via the shank and the bearing hole;

an annular recess formed in the sidewall member at an edge of the bearing hole facing a side face of the vane-rotor main body, the annular recess having a diameter smaller than an outer diameter of the vane-rotor main body; and a radial groove formed in a side face of the sidewall member on the side of the vane-rotor main body, the radial groove providing fluid communication between the annular recess and one of the advance and retard chambers.

3. The valve timing control system as claimed in claim 2, further comprising a taper formed on a bottom of the annular recess in the axial direction, the taper inclining toward a general surface of the bearing hole in a taper way.

4. The valve timing control system as claimed in claim 2, wherein the radial groove is disposed to open to one of a side face of the partition wall on the side of the advance chamber and a side face of the partition wall on the side of the retard chamber.

5. The valve timing control system as claimed in claim 2, further comprising a power transfer part integrated with the sidewall member of the housing, the power transfer part serving to transfer torque of the crankshaft.

6. The valve timing control system as claimed in claim 2, wherein the housing main body comprises a cylindrical member and a cover member.

7. The valve timing control system as claimed in claim 2, further comprising a radial hole radially formed through the shank, wherein the working fluid is supplied and discharged to and from the annular recess through the radial hole.

8. The valve timing control system as claimed in claim 7, further comprising a connection hole formed in the center of the front of the vane rotor and a supply/discharge rod arranged through the connection hole to carry out supply and discharge of the working fluid out of the hydraulic-pressure supply/discharge device.

9. The valve timing control system as claimed in claim 8, wherein the connection hole extends up to the shank, wherein the radial hole is connected to the connection hole.

10. The valve timing control system as claimed in claim 9, further comprising a cam bolt arranged on a bottom of the connection hole to integrally couple the camshaft to the vane rotor.

11. The valve timing control system as claimed in claim 10, wherein the cam bolt has a head with a circular section.

12. The valve timing control system as claimed in claim 10, wherein the connection hole extends up to substantially a middle position of the shank.

13. The valve timing control system as claimed in claim 8, wherein the supply/discharge rod is formed with a VTC cover mounted to a front end of a cylinder head to protrude axially inward.

14. The valve timing control system as claimed in claim 7, wherein the shank is integrated with the vane rotor.

15. The valve timing control system as claimed in claim 5, wherein the power transfer part comprises a chain sprocket.

16. The valve timing control system as claimed in claim 2, further comprising a lock mechanism restricting the relative rotation between the housing and the vane rotor at engine start, the lock mechanism comprising:

a pin hole axially formed in one of the vane of the vane rotor;

a lock pin slidably accommodated in the pin hole;

a biasing member accommodated in the pin hole together with the lock pin to bias the lock pin toward the sidewall member;

a lock hole formed in the sidewall member to engage with a front end of the lock pin; and a release mechanism which releases locking of the lock pin.

17. The valve timing control system as claimed in claim 16, wherein the release mechanism comprises a release passage serving to operate the lock releasing hydraulic pressure to the lock pin.

18. The valve timing control system as claimed in claim 2, wherein the annular recess and the radial groove comprise die formed annular recess and redial groove.

19. The valve timing control system as claimed in claim 18, wherein the annular recess and the radial groove have openings having a direction corresponding to a mold direction.

20. A valve timing control system for an internal combustion engine, comprising:

a housing comprising a peripheral wall and partition walls protruding radially inward from the peripheral wall, the housing being rotated by torque transmitted from a crankshaft;

a vane rotor arranged in the housing, the vane rotor comprising a substantially cylindrical main body with which front ends of the partition walls make slide contact and vanes protruding radially outward from the main body, the vane rotor being integrated with a camshaft to be rotatable together, the vane rotor being mounted to the housing to be rotatable relative thereto as required;

advance and retard chambers formed between the partition walls of the housing and the vanes of the vane rotor;

a hydraulic-pressure supply/discharge device which selectively supplies and discharges a working fluid to and from the advance and retard chambers to cause a relative rotation between the housing and the vane rotor, the hydraulic-pressure supply/discharge device comprising two supply/discharge passages, the housing comprising a main body having the peripheral wall and a sidewall member mounted to the main body to close a side of the main body on the side of the camshaft, the sidewall member being formed with a bearing hole having a diameter smaller than that of the vane-rotor main body and supporting a shank provided to one of the vane rotor and the camshaft, one of the supply/discharge passages of the hydraulic-pressure supply/discharge device connecting the sidewall member to one of the advance and retard chambers via the shank and the bearing hole;

an annular recess formed in the sidewall member at an edge of the bearing hole facing a side face of the vane-rotor main body, the annular recess having a diameter smaller than an outer diameter of the vane-rotor main body; and a communication groove formed in a side face of the sidewall member on the side of the vane-rotor main body, the communication groove providing fluid communication between the annular recess and one of the advance and retard chambers.

* * * * *